US008904694B1

(12) United States Patent
Afuh, II

(10) Patent No.: US 8,904,694 B1
(45) Date of Patent: Dec. 9, 2014

(54) DEBRIS COVER FOR A WEAPON MAGAZINE WELL

(71) Applicant: Jeremiah A. Afuh, II, Lincoln, NE (US)

(72) Inventor: Jeremiah A. Afuh, II, Lincoln, NE (US)

( * ) Notice: Subject to any disclaimer, the term of this patent is extended or adjusted under 35 U.S.C. 154(b) by 0 days.

(21) Appl. No.: 14/181,046

(22) Filed: Feb. 14, 2014

(51) Int. Cl.
*F41A 35/02* (2006.01)
*F41A 9/00* (2006.01)

(52) U.S. Cl.
CPC .. *F41A 9/00* (2013.01); *F41A 35/02* (2013.01)
USPC ..... 42/96

(58) Field of Classification Search
CPC ..... F41C 27/00; F41A 9/61; F41A 9/64; F41A 9/65; F41A 27/00; F41A 35/00; F41A 35/02
USPC ..... 206/317; 42/96, 49.01, 49.02, 50, 6, 90, 42/106
See application file for complete search history.

(56) References Cited

U.S. PATENT DOCUMENTS

| | | | | |
|---|---|---|---|---|
| 5,048,217 | A | 9/1991 | Easter | |
| 6,256,922 | B1 | 7/2001 | Jones et al. | |
| 7,587,851 | B1 | 9/2009 | Luth | |
| 7,823,312 | B2 * | 11/2010 | Faifer | 42/49.02 |
| 7,891,129 | B2 * | 2/2011 | Parry et al. | 42/96 |
| 8,127,480 | B1 * | 3/2012 | McManus et al. | 42/49.02 |
| 8,590,203 | B1 * | 11/2013 | McCarthy et al. | 42/96 |
| 2010/0154275 | A1 * | 6/2010 | Faifer | 42/90 |
| 2010/0281748 | A1 * | 11/2010 | Parry et al. | 42/96 |
| 2012/0073176 | A1 * | 3/2012 | McManus et al. | 42/6 |
| 2012/0233902 | A1 * | 9/2012 | McCarthy et al. | 42/96 |
| 2013/0312308 | A1 * | 11/2013 | McCarthy et al. | 42/96 |

* cited by examiner

*Primary Examiner* — Jonathan C Weber
(74) *Attorney, Agent, or Firm* — Crossley Patent Law

(57) ABSTRACT

A debris cover for a weapon magazine well that that does not need to be removed in order to add a magazine onto a firearm. The instant device includes a housing with an opening that can be secured over the magazine well of a firearm such and is fastenable inside the trigger well. The housing has a lower opening wide enough to receive a magazine therethrough. Spring hinges are disposed proximal the lower opening. A plurality of door panels has a surface with a low coefficient of friction and is fixedly attached to and in operational communication with the spring hinges. The spring hinges bias the door panels to span the lower opening. The door panels can also fold up inside the debris cover allowing for the insertion of a magazine into the magazine well.

10 Claims, 5 Drawing Sheets

DEBRIS COVER FOR A WEAPON MAGAZINE WELL

BACKGROUND OF THE INVENTION

Various types covers for firearm magazine wells are known in the prior art. One of the shortcomings of these magazine well covers is that they must be removed prior to adapting a magazine onto the firearm. Thus, a user, such as a military personnel, must remove the magazine well cover prior to adapting a magazine onto the firearm. In situations where time is of the essence, the extra time and effort necessary to remove the magazine cover results in a decreased response time by the user. It also serves as an unnecessary distraction that requires diversion of the users attention when other matters, such as quickly loading and re-loading a magazine, are more pressing. Thus, in order to improve reaction time and eliminate unnecessary distractions, what is needed is a debris cover for a weapon magazine well that that does not need to be removed in order to add a magazine to a firearm and allows for seamless protection of the magazine well from dust and debris while changing the firearm magazine or storing the firearm without a magazine. The instant device includes a parallelepiped housing with an upper perimeter and a lower perimeter. The upper perimeter defines an opening that can be placed over the outside of the magazine well of a firearm such as the M-4 carbine magazine well, and is fastenable inside the trigger well of the of the firearm. The lower perimeter defines an opening that is wide enough to receive a magazine therethrough. Spring hinges are disposed proximal the lower perimeter. A plurality of door panels having a surface with a low coefficient of friction are fixedly attached to and in operational communication with the spring hinges and have a collective surface area sufficient to span the lower opening. The spring hinges are configured to bias the door panels towards a flush registered alignment closing the lower opening when the firearm is without a magazine. The spring hinges are also configured to allow the door panels to fold in and rest proximal the inner perimeter of the housing upon insertion of the magazine through the lower opening of the housing.

The door panels fold up inside the debris cover short of the bottom of the magazine well allowing for the insertion of a magazine through the debris cover and into the magazine well. The magazine release function of the firearm is not affected by the debris cover, thus the thus the debris cover allows for seamless protection of the magazine well from dust and debris while changing the firearm magazine or storing the firearm without a magazine.

FIELD OF THE INVENTION

The present invention relates to a debris cover for a weapon magazine well which does not need to be removed in order to add a magazine to a firearm and allows for seamless protection of the magazine well from dust and debris while changing the firearm magazine or storing the firearm without a magazine.

SUMMARY OF THE INVENTION

The general purpose of the present debris cover for a weapon magazine well, described subsequently in greater detail, is to provide a debris cover for a weapon magazine well which has many novel features that result in a debris cover for a weapon magazine well which is not anticipated, rendered obvious, suggested, or even implied by prior art, either alone or in combination thereof.

To accomplish this, the present debris cover for a weapon magazine well includes a housing having a front wall, two identical side walls, a rear wall, an upper perimeter and a lower perimeter. Each of the front, side, and rear walls define a continuous outer perimeter and a continuous inner perimeter of the housing. The upper perimeter defines an upper opening wide enough to encompass a firearm magazine well, such as that of a M-4 carbine firearm. The lower perimeter defines a lower opening wide enough to receive the magazine therethrough. A trigger guard aperture is disposed on the rear wall proximal the upper perimeter.

A retaining band is continuously disposed around the outer perimeter of the housing proximal the upper perimeter. The retaining band has a fastening mechanism proximal the trigger guard aperture, such as a locking clasp, for removably securing the debris cover to the magazine well of the firearm.

A plurality of spring hinges are disposed around the inner perimeter of the housing proximal the lower perimeter. A plurality of door panels each having a surface with a low coefficient of friction are fixedly attached to and in operational communication with the spring hinges. The door panels have a collective surface area sufficient to span the lower opening. The spring hinges are configured to bias the door panels towards a flush registered alignment closing the lower opening when the firearm is without a magazine. The spring hinges are also configured to allow the door panels to fold in and rest proximal the inner perimeter of the housing upon insertion of the magazine through the lower opening of the housing.

The debris cover can be placed over the outside of the magazine well of the firearm, such as the M-4 carbine magazine well, and is fastened inside a trigger well of the of the firearm. The door panels can then fold up inside the housing short of the magazine well allowing for the insertion of a magazine through the debris cover and into the magazine well. The magazine release function of the firearm is not affected by the debris cover, thus the debris cover allows for seamless protection of the magazine well from dust and debris while changing the firearm magazine or storing the firearm without a magazine.

Thus has been broadly outlined the more important features of the present debris cover for a weapon magazine well so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
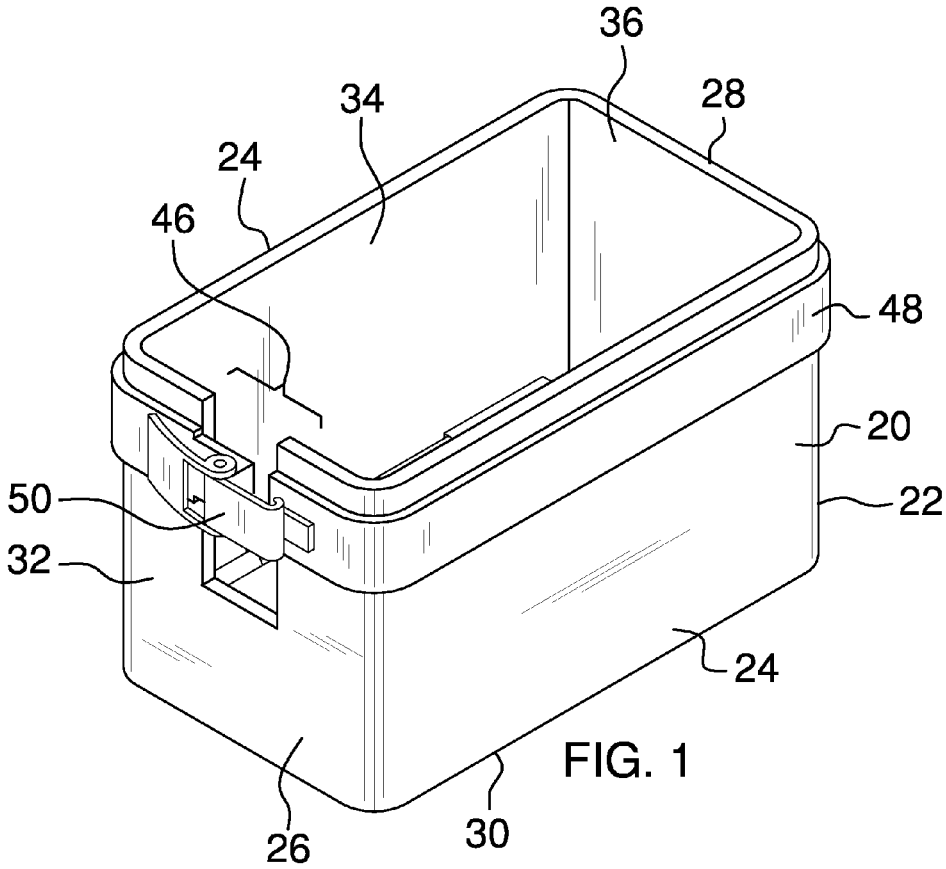
FIG. 1 is a diagonal rear perspective view.
Figure 2:
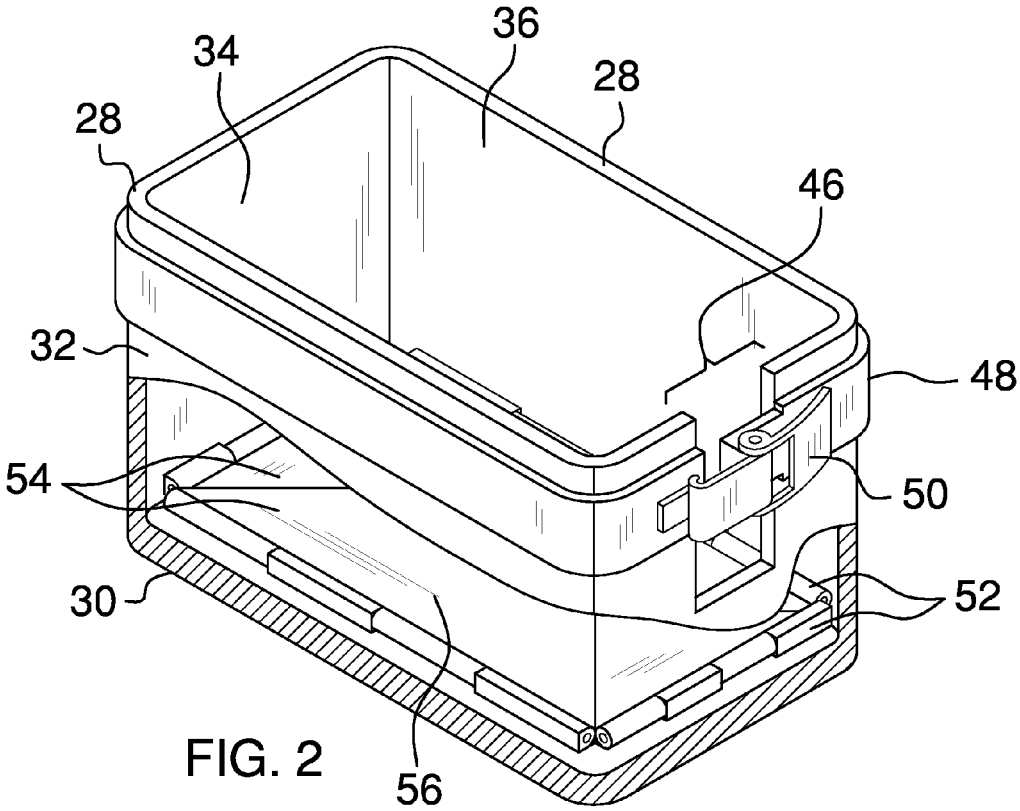
FIG. 2 is a diagonal rear perspective view with a partial cutaway view of a plurality of spring hinges and a plurality of floor panels.
Figure 3:
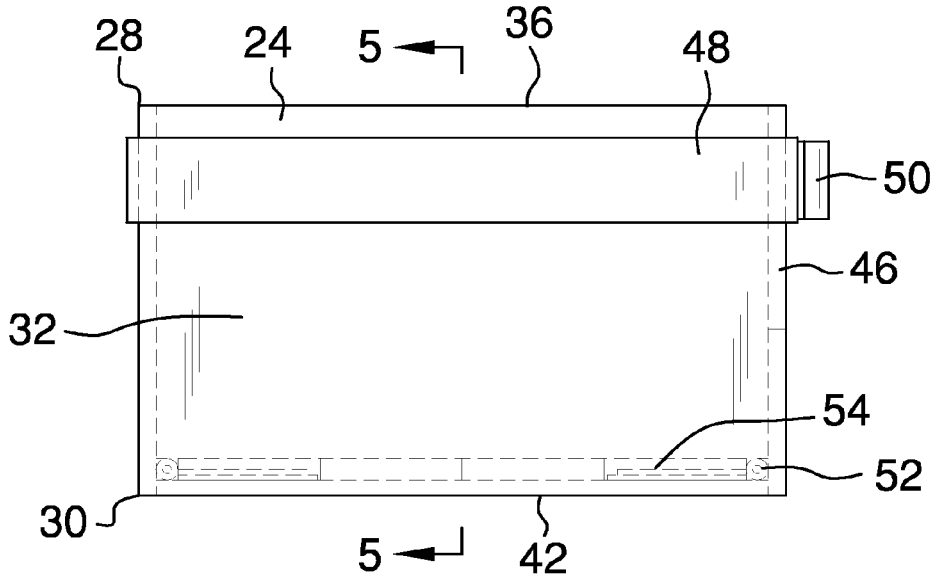
FIG. 3 is a side view.
Figure 4:
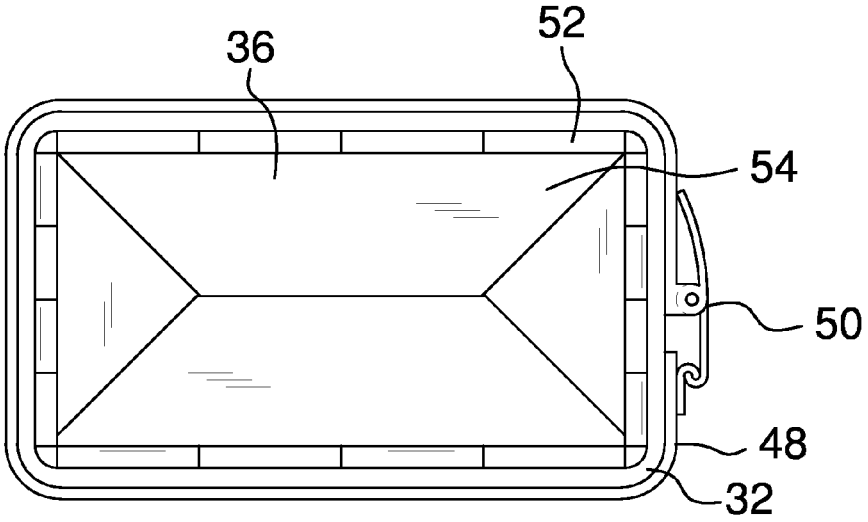
FIG. 4 is a top plan view.
Figure 5B:
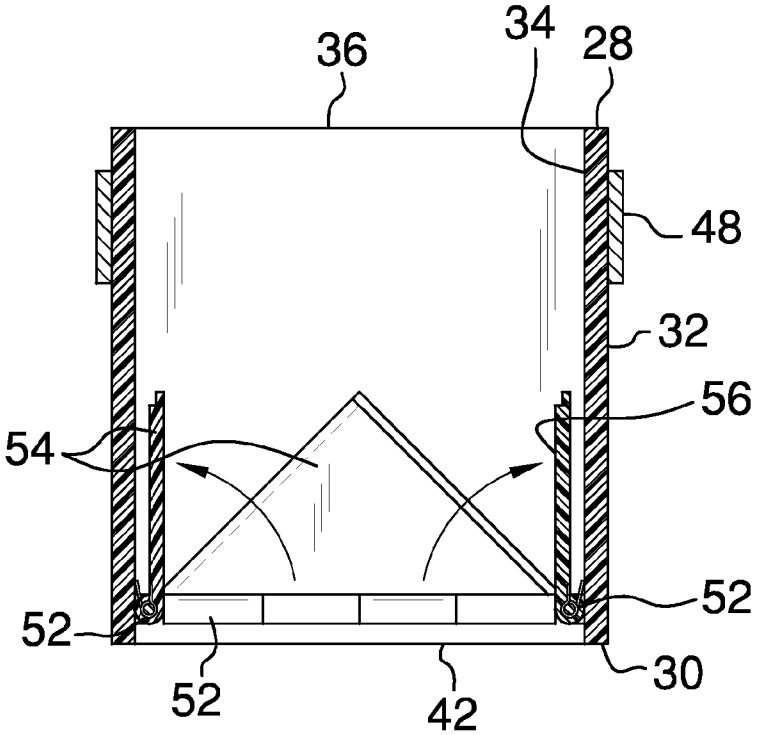
FIG. 5*b* is a cross-sectional view taken along line 5-5 of FIG. 3 in an open position.
Figure 5A:
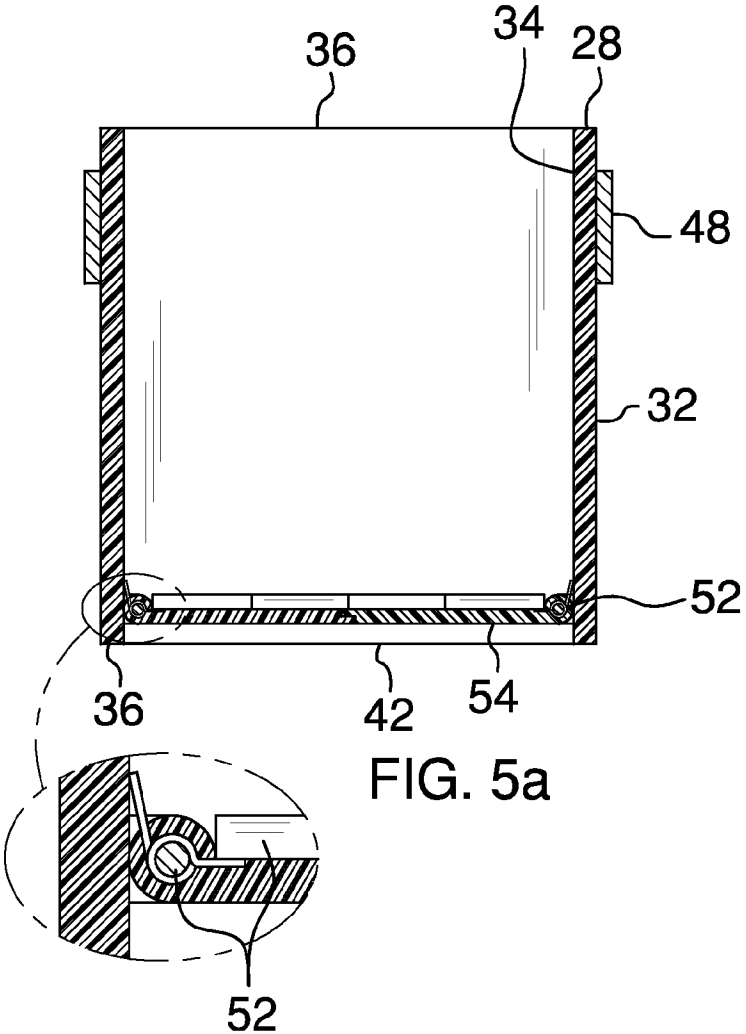
FIG. 5*a* is a cross-sectional view taken along line 5-5 of FIG. 3 in a closed position.
Figure 6:
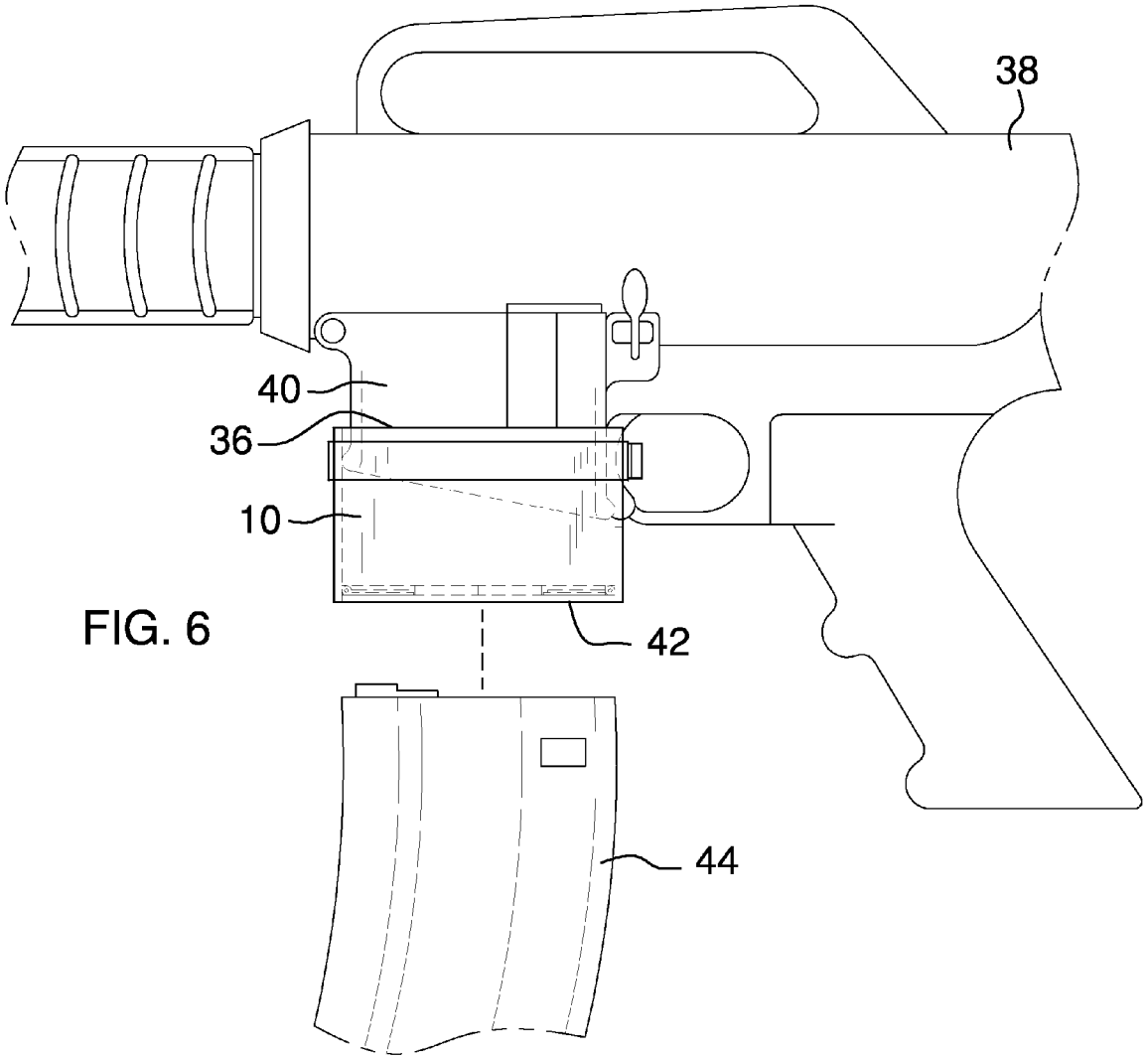
FIG. 6 is an in-use isometric view.

With reference now to the drawings, and in particular FIGS. 1 through 6 thereof, an example of the instant debris cover for a weapon magazine well employing the principles and concepts of the present debris cover for a weapon magazine well and generally designated by the reference number 10 will be described.

Referring to FIGS. 1 through 6 the present debris cover for a weapon magazine well 10 is illustrated. The debris cover for a weapon magazine well 10 includes a parallelepiped housing 20 having a front wall 22, two identical side walls 24, a rear wall 26, an upper perimeter 28 and a lower perimeter 30. Each of the front 22, side 24, and rear 26 walls define a continuous outer perimeter 32 and a continuous inner perimeter 34 of the housing 20. The upper perimeter 28 defines an upper opening 36 wide enough to encompass a firearm 38 magazine well 40, such as that of a M-4 carbine firearm. The lower perimeter 30 defines a lower opening 42 wide enough to receive the magazine 44 therethrough. A trigger guard aperture 46 is disposed on the rear wall 26 proximal the upper perimeter 28.

A retaining band 48 is continuously disposed around the outer perimeter 32 of the housing 20 proximal the upper perimeter 28. The retaining band 48 has a fastening mechanism 50 proximal the trigger guard aperture 46, such as a locking clasp, for removably securing the debris cover 10 to the magazine well 40 of the firearm.

A plurality of spring hinges 52 are disposed around the inner perimeter 34 of the housing 20 proximal the lower perimeter 30. A plurality of door panels 54 each having a surface 56 with a low coefficient of friction are fixedly attached to and in operational communication with the spring hinges 52. The door panels 54 have a collective surface area sufficient to span the lower opening 42. The spring hinges 52 are configured to bias the door panels 54 towards a flush registered alignment closing the lower opening 42 when the firearm 38 is without a magazine 44. The spring hinges 52 are also configured to allow the door panels 54 to fold in and rest proximal the inner perimeter 34 of the housing 20 upon insertion of the magazine 44 through the lower opening 42 of the housing 20.

The debris cover 10 can be placed over the outside of the magazine well 40 of the firearm 48, such as the M-4 carbine magazine well, and is fastened inside a trigger well 58 of the of the firearm 38. The door panels 54 can then fold up inside the housing 20 short of the magazine well 40 allowing for the insertion of a magazine 44 through the debris cover 10 and into the magazine well 40. The magazine 44 release function of the firearm 38 is not affected by the debris cover 10, thus the debris cover 10 allows for seamless protection of the magazine well 40 from dust and debris while changing the firearm 38 magazine 44 or storing the firearm 38 without a magazine 44.

What is claimed is:

1. A debris cover for a weapon magazine well comprising:

a parallelepiped housing having a front wall, two identical side walls, a rear wall, an upper perimeter, and a lower perimeter, each wall defining a continuous outer perimeter and a continuous inner perimeter of the housing, the upper perimeter defining an upper opening wide enough to encompass the magazine well of a firearm, the lower perimeter defining a lower opening wide enough to receive a magazine therethrough, wherein the housing is configured to engage the magazine well of the firearm;

a trigger guard aperture disposed on the rear wall proximal the upper perimeter;

a retaining band continuously disposed around the outer perimeter proximal the upper perimeter, the retaining band having a fastening mechanism proximal the trigger guard aperture, the fastening mechanism configured to removably securing the debris cover to the magazine well of the firearm;

a plurality of spring hinges disposed along the inner perimeter of the housing proximal the lower perimeter; and a plurality of door panels having a surface with a low coefficient of friction, the door panels fixedly pivotally attached to and in operational communication with the spring hinges, the door panels having a collective surface area sufficient to span the lower opening, each spring hinge configured to bias the door panels towards a flush registered alignment closing the lower opening, the spring hinges configured to alternately allow the door panels to fold in and rest proximal the inner perimeter of the housing upon insertion of the magazine through the lower opening of the housing.

2. The debris cover for a weapon magazine well of claim 1 wherein the housing is configured to engage the magazine well of a carbine firearm.

3. The debris cover for a weapon magazine well of claim 1 wherein the housing is configured to engage the magazine well of an M-4 carbine firearm.

4. The debris cover for a weapon magazine well of claim 1 wherein the fastening mechanism is a locking clasp.

5. The debris cover for a weapon magazine well of claim 1 wherein the floor panels are configured to permit unobstructed release of the magazine from the magazine well upon action by a user to release of the magazine from the magazine well.

6. The debris cover for a weapon magazine well of claim 1 wherein the retaining band is permanently affixed to the outer perimeter proximal the upper perimeter.

7. The debris cover for a weapon magazine well of claim 2 wherein the fastening mechanism is a locking clasp.

8. The debris cover for a weapon magazine well of claim 3 wherein the fastening mechanism is a locking clasp.

9. A debris cover for a weapon magazine well comprising:

a parallelepiped housing having a front wall, two identical side walls, a rear wall, an upper perimeter and a lower perimeter, each wall defining a continuous outer perimeter and a continuous inner perimeter of the housing, the upper perimeter defining an upper opening wide enough to encompass the magazine well of a firearm, the lower perimeter defining a lower opening wide enough to receive a magazine therethrough, wherein the housing is configured to engage the magazine well of the firearm;

a trigger guard aperture disposed on the rear wall proximal the upper perimeter;

a retaining band continuously disposed around the outer perimeter proximal the upper perimeter, the retaining band having a fastening mechanism proximal the trigger guard aperture for removably securing the debris cover to the magazine well of the firearm; and a plurality of door panels made of a flexible plastic, each door panel having a surface with a low coefficient of friction, the door panels disposed on the inner perimeter of the housing proximal the lower perimeter, the door panels having a collective surface area sufficient to span the lower opening, the flexible plastic configured to bias the door panels towards a flush registered alignment closing the lower opening, the flexible plastic configured to allow the door panels to fold in and rest proximal the inner perimeter of the housing upon insertion of the magazine through the lower opening of the housing.

10. A debris cover for a weapon magazine well comprising:

a parallelepiped housing having a front wall, two identical side walls, a rear wall, an upper perimeter and a lower perimeter, each wall defining a continuous outer perimeter and a continuous inner perimeter of the housing, the upper perimeter defining an upper opening wide enough to encompass the magazine well of a M-4 carbine firearm, the lower perimeter defining a lower opening wide enough to receive the M-4 carbine firearm magazine therethrough, wherein the housing is configured to engage the magazine well of the firearm;

a trigger guard aperture disposed on the rear wall proximal the upper perimeter;

a retaining band continuously disposed around the outer perimeter proximal the upper perimeter, the retaining band having a fastening mechanism proximal the trigger guard aperture for removably securing the debris cover to the magazine well of the M-4 carbine firearm;

a plurality of spring hinges disposed along the inner perimeter of the housing proximal the lower perimeter; and four door panels having a surface with a low coefficient of friction, the door panels fixedly attached to and in operational communication with the spring hinges, the door panels having a collective surface area sufficient to span the lower opening, each spring hinge configured to bias the door panels towards a flush registered alignment closing the lower opening, the spring hinges configured to alternately allow the door panels to fold in and rest proximal the inner perimeter of the housing upon insertion of the magazine through the lower opening of the housing;

wherein the debris cover is configured to be placed over the outside of the magazine well of the M-4 carbine firearm and fastened inside the trigger well of the firearm;

wherein the door panels fold up inside the debris cover short of the bottom of the magazine well, wherein the door panels are configured to allow the insertion of a magazine through the debris cover and into the magazine well; and wherein the floor panels are configured to permit unobstructed release of the magazine from the magazine well upon action by a user to release of the magazine from the magazine well.

* * * * *